US009601036B2

(12) United States Patent
Barnard, IV

(10) Patent No.: US 9,601,036 B2
(45) Date of Patent: Mar. 21, 2017

(54) ROOF PARAPET MOUNTED ADJUSTABLE BRACKET FOR HANGING A GRAPHIC SIGN PANEL

(71) Applicant: James Robert Barnard, IV, La Mesa, CA (US)

(72) Inventor: James Robert Barnard, IV, La Mesa, CA (US)

( * ) Notice: Subject to any disclaimer, the term of this patent is extended or adjusted under 35 U.S.C. 154(b) by 0 days.

(21) Appl. No.: 15/186,354

(22) Filed: Jun. 17, 2016

(65) Prior Publication Data

US 2017/0032714 A1 Feb. 2, 2017

Related U.S. Application Data

(60) Provisional application No. 62/197,636, filed on Jul. 28, 2015.

(51) Int. Cl.
*G09F 7/20* (2006.01)
*G09F 7/18* (2006.01)

(52) U.S. Cl.
CPC ..... *G09F 7/20* (2013.01); *G09F 2007/1847* (2013.01); *G09F 2007/1856* (2013.01)

(58) Field of Classification Search
CPC ..... G09F 7/20; G09F 2007/1847; G09F 2007/1856
USPC ... 248/245, 236, 295.11, 297.21, 298.1, 235, 248/241, 242, 244, 250
See application file for complete search history.

(56) References Cited

U.S. PATENT DOCUMENTS 370,739 A 9/1887 Hysan
2,717,139 A * 9/1955 Jewell ..... F24F 13/32 182/57
3,084,759 A 4/1963 Squire
3,164,353 A * 1/1965 Rene ..... E04G 3/26 108/6
3,459,277 A * 8/1969 Frederick ..... E06C 7/48 182/214
3,480,257 A 11/1969 Bourn
3,595,510 A * 7/1971 Hutchinson ..... E04G 5/06 182/113
3,664,626 A 5/1972 Sneller
3,747,898 A * 7/1973 Warren ..... E04G 21/3233 182/113
3,776,498 A * 12/1973 Peters ..... E04G 5/06 182/82
3,863,900 A 2/1975 Dagiel et al.
3,901,481 A 8/1975 Probst
3,978,989 A * 9/1976 Avila, Jr. ..... B66C 23/22 212/176
3,995,833 A 12/1976 McLaughlin et al.
4,367,857 A 1/1983 McCarthy
4,542,804 A 9/1985 Power
4,546,973 A * 10/1985 Mouser ..... A63B 63/083 248/225.21
5,265,742 A 11/1993 Stenger et al.
5,348,118 A * 9/1994 Franklin, III ..... E04G 5/06 174/84 R
5,544,851 A 8/1996 Moore
(Continued)

*Primary Examiner* — Nkeisha Smith
(74) *Attorney, Agent, or Firm* — Buche & Associates, P.C.; John K. Buche; Bryce A. Johnson

(57) ABSTRACT

Disclosed is a roof parapet mounted adjustable bracket for hanging a sign panel. The adjustable bracket is able to fit a variety of widths of parapets and allows a user to change a sign without removing the bracket from a parapet.

8 Claims, 2 Drawing Sheets

(56) References Cited

U.S. PATENT DOCUMENTS

| | | | | |
|---|---|---|---|---|
| 5,685,511 | A | 11/1997 | Ghany et al. | |
| 6,038,829 | A * | 3/2000 | Franks | E04G 3/26 182/113 |
| 6,039,150 | A * | 3/2000 | Palmer | E04G 3/26 182/113 |
| 6,053,281 | A * | 4/2000 | Murray | E04G 21/3223 182/113 |
| 6,135,300 | A | 10/2000 | Fox | |
| 6,533,069 | B1 | 3/2003 | Couillard | |
| 6,585,080 | B2 | 7/2003 | Murray | |
| 6,591,574 | B2 * | 7/2003 | Humphrey | E04G 13/00 248/200.1 |
| 6,886,662 | B2 * | 5/2005 | Riley | E04G 3/22 182/150 |
| 6,910,678 | B2 | 6/2005 | Small | |
| 7,032,268 | B2 * | 4/2006 | Jackson | E01D 21/00 14/78 |
| 7,044,313 | B2 | 5/2006 | Haliburda, III | |
| 7,117,620 | B2 | 10/2006 | Tolna | |
| 7,159,262 | B2 * | 1/2007 | Jackson | E01D 21/00 14/77.1 |
| 7,284,746 | B2 | 10/2007 | Kuenzel | |
| 7,530,551 | B2 | 5/2009 | Kuenzel | |
| 7,806,232 | B2 | 10/2010 | Thomas et al. | |
| 8,584,998 | B1 * | 11/2013 | Peterson | F24F 13/32 3/32 |
| 2012/0137499 | A1 * | 6/2012 | Agnihotri | F16M 13/02 29/462 |

* cited by examiner

ROOF PARAPET MOUNTED ADJUSTABLE BRACKET FOR HANGING A GRAPHIC SIGN PANEL

CROSS-REFERENCE TO RELATED APPLICATIONS

This application claims the benefit and priority of U.S. Provisional App. Ser. No. 62/197,636 (filed Jul. 28, 2015) entitled "Roof parapet mounted adjustable bracket for hanging a graphic sign panel."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of roof parapet brackets for hanging signs.

Background of the Invention

Signs are used in a variety settings to notify a passerby or potential customer of a store, event, or promotion. With some buildings, a sign must be displayed from a parapet, which is a low wall along the edge of a roof. Generally, hanging a graphic sign panel from a building requires a lot of time, effort, and special lifting and drilling devices. In some instances, to fix a bracket to a wall, a user must obtain special lifting equipment to reach higher areas of a building and mounting brackets must be secured onto the building by drilling holes into the building's façade to accommodate the bracket's mounting bolts. Moreover, hanging signs from parapets has proven to be a difficult task because of the variety of widths and styles of parapets, so there is a need for an adjustable bracket that can fit on a variety of parapets. In fact, traditional mounting of a sign bracket to a building is usually done by hiring an outside contractor with special equipment to accomplish the mounting.

Additionally, signs need to be changed at times, but this, again, requires special equipment and drilling tools to remove the bracket and change signs. The present invention allows a user to change a sign without removing the bracketed mount.

Other inventors have tried to make hanging signs from parapets an easier task, however, the prior art contraptions do not allow a user to easily install a bracket on a parapet for hanging a sign that is easily adjustable and does not require drilling. For example, U.S. Pat. No. 3,664,626 to Sneller discloses a bracket for mounting decorations on a building front, however, adjusting Sneller's bracket requires tools and more time and effort than adjusting the present invention. U.S. Pat. No. 6,910,678 to Small discloses a bracket for supporting banners from a parapet, however, the amount of adjustability is limited to the length of a screw and the bracket does not allow for easily interchanging signs. These examples and other prior art fail to provide sturdy, seamless, and effortless apparatus and method of installing an adjustable bracket on a parapet and interchanging signs from the adjustable bracket. Furthermore, both of these examples and other prior art only allow a sign to be displayed very close to a wall. Thus, a need exits for a sign bracket that can be installed on a variety of parapets and allows for interchangeable signs without the need for special lifting or drilling.

In view of the foregoing, Applicant discloses an adjustable parapet sign bracket that eliminates the need to hire a contractor or use special lifting or drilling devices to install and hang a sign from a variety of parapet walls.

SUMMARY OF THE INVENTION

In view of the foregoing, an object of this specification is to disclose an adjustable bracket for mounting signs from a roof parapet.

Another object of this specification is to disclose an adjustable bracket that can be secured to a variety of widths of parapets.

Another object of this specification is to disclose an adjustable bracket that allows a user to easily change a sign without removing the bracket from a parapet.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is an adjustable bracket for mounting signs on a roof parapet.

Figure 1:
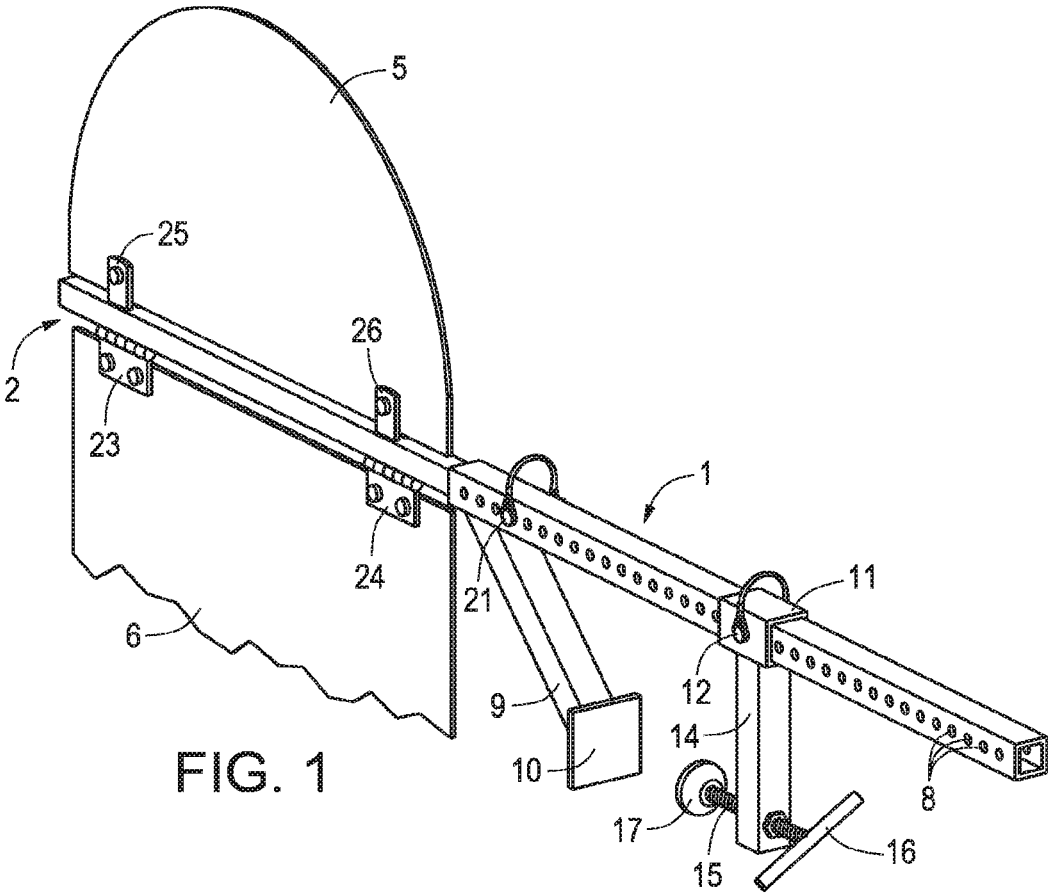
FIG. 1 is a perspective view of the parapet bracket for mounting signs.

FIG. 1 is a perspective view of the adjustable bracket for mounting signs on a parapet. Referring to FIG. 1, in a preferred embodiment, an adjustable beam 1 features a perforated beam with through holes 8 and a removable assembly 2. The adjustable beam 1 also features a support shaft 9 that has a plate 10 that comes into contact with the outer wall of a parapet 3 (see FIG. 2). In one embodiment, a support shaft 9 extends from the adjustable beam 1 at an acute angle. Additionally, the plate 10 is orientated on the support shaft 9 to in a manner that accommodates being pressed flush against the outside wall of a parapet 3. The acute angle allows a sign panel 5,6 to be displayed farther away from a wall. The acute angle of the support shaft 9 also provides leverage to pull the plate 10 against the outside wall of a parapet 3. The invention also features a removable assembly 2, which is a beam that may slide into one end of the adjustable beam 1. The removable assembly 2 may feature a hole 20 (see FIG. 2) and fastening brackets 23, 24, 25, 26 to hold sign panels. In one embodiment, the fastening brackets 23, 24 may be hinged to support a swinging sign.

Still referring to FIG. 1, an adjustment column 14, which features an adjustment rod 15 with a handle 16 and a wall stop 17 and a sliding module 11 that may slide along the adjustable beam 1. The sliding module 11 may feature a hole, wherein an adjustment column pin 12 is inserted through the sliding module 11 and into a through hole 8 on the adjustable beam 1 when the desired width is selected to fit the width of a parapet 3. The adjustable beam 1 may also feature a removable assembly pin 21 that secures the removable assembly 2 to the adjustable beam 1 when a desired length is selected. In a preferred embodiment, the components of the invention are made of steel or other rigid metal.

Figure 2:
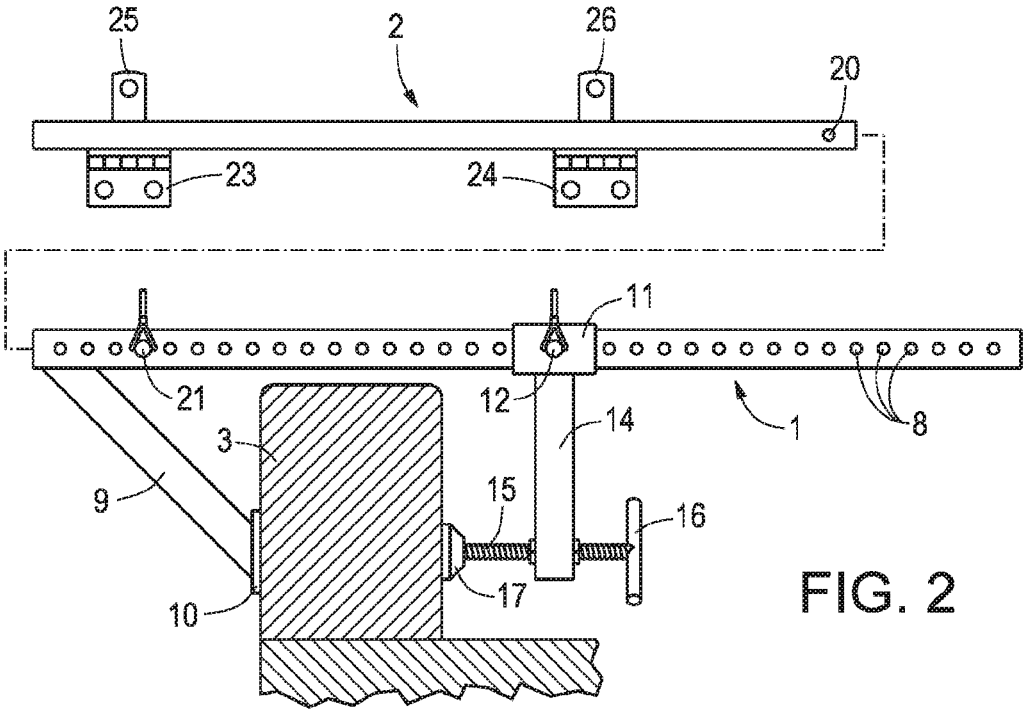
FIG. 2 is a front view of the parapet bracket of FIG. 1.

FIG. 2 is a front view of the adjustable bracket for mounting signs to a parapet. Referring to FIG. 2, in use, a user will insert the removable assembly 2 into the adjustable beam 1 through the end closest to the support shaft 9. When the desired protrusion length of the removable assembly 2 is reached, a user will match the removable assembly's hole 20 with a through hole 8 of the adjustable beam 1 and insert the removable assembly pin 21 through the removable assembly hole 20 and adjustable beam's through hole 8 to secure the removable assembly 2 to the adjustable beam 1. To mount the bracket on a parapet 3, a user may slide the sliding module 11 to point where the desired width between the support shaft's plate 10 and adjustable column's wall stop 17 is slightly larger than the width of the parapet 3. The user may insert the adjustment column pin 12 through the hole in the sliding module 11 and a through hole 8 to secure the adjustment column 14 to the adjustable beam 1. A user may then press the plate 10 of the support shaft 9 flush against the outer wall of a parapet 3 and adjust the adjustment rod 15 so that the wall stop 17 presses firmly against the inside wall of the parapet 3. Accordingly, unlike prior art, there are two points of adjustment to accommodate a variety of parapets 3. There is one point of adjustment along the perforated beam of the adjustment assembly 2 and there is another point of adjustment with the adjustment rod 15. This additional point of adjustment gives the bracket more stability without sacrificing additional adjustability because it does not rely on longer screws to secure the bracket to a parapet 3.

Figure 3:
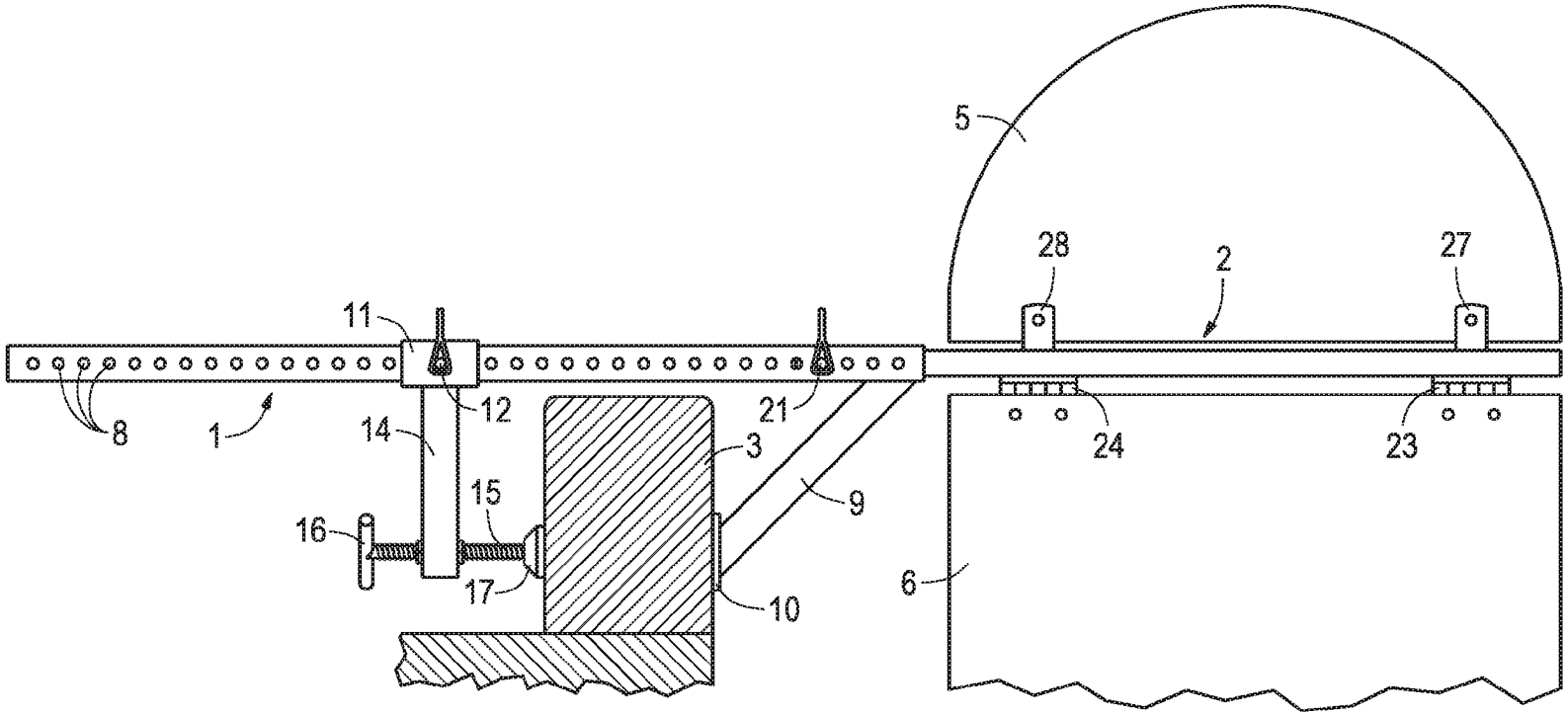
FIG. 3 is a back view of the parapet bracket of FIG. 1.

FIG. 3 is a back view of the adjustable bracket and depicts one embodiment of the adjustable bracket firmly secured to a parapet. In one embodiment, an upper panel 5 may be secured by bolts attached to fixed brackets 27, 28. In another embodiment, a lower panel 6 may be secured to brackets 23, 24, so that the lower panel 6 may be displayed. In an alternative embodiment, the brackets 23, 24 may be hinged so that a sign may swing without coming into contact with a building. In one embodiment, the sign, or upper and lower panels 5, 6, may be changed without removing the adjustable beam 1 from the parapet 3 by removing the pin 21 from the removable assembly 2 and sliding the removable assembly 2 out from the adjustable beam 1. In one embodiment, the pins 12, 21 may be clevis pins.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. An adjustable bracket for hanging signs from a parapet comprising:

an adjustable beam with a first end and a second end, wherein the beam is a perforated and receives at least one pin;

a removable assembly that is configured to be slideably inserted into the first end of the adjustable beam;

a support shaft that is fastened to the first end of the adjustable beam and extends from the adjustable beam at an acute angle;

an adjustment column that slides along the adjustable beam via a sliding module, wherein the adjustment column features an adjustment rod;

wherein the removable assembly features at least one fastening bracket; and, wherein the fastening bracket is hinged.

2. A method of displaying a sign from a parapet wall comprising:

obtaining an adjustable bracket comprising an adjustable beam with a first end and a second end, wherein the adjustable beam is perforated and receives at least one pin, a removable assembly that is configured to be slideably inserted into the first end of the adjustable beam, a support shaft that is fastened to the first end of the adjustable beam, wherein the support shaft extends from the adjustable beam at an acute angle and features a plate, and, an adjustment column that slides along the adjustable beam via a sliding module, wherein the adjustment column features an adjustment rod, wherein the adjustment rod features a wall stop;

fastening a sign onto the removable assembly;

securing the removable assembly to the adjustment beam;

opening a space between the support shaft's plate and the adjustment column by moving the sliding module along the adjustable beam, wherein the space is wider than a width of a parapet;

placing the support shaft's plate against an outside wall of a parapet; and, adjusting the adjustment rod, wherein the wall stop presses firmly against with an inside wall of the parapet.

3. The method of claim 2, wherein the removable assembly is configured to receive an upper panel sign.

4. The method of claim 3, wherein the removable assembly is configured to receive a lower panel sign.

5. The method of claim 2, wherein the removable assembly features a fastening bracket.

6. The method of claim 3, wherein the fastening bracket is hinged.

7. The method of claim 2, wherein the adjustment rod is threaded.

8. The method of claim 2, wherein the removable assembly features a hole to receive a pin that travels through the removable assembly.

* * * * *